US008146214B2

(12) United States Patent
Peters et al.

(10) Patent No.: US 8,146,214 B2
(45) Date of Patent: Apr. 3, 2012

(54) ZIPPER

(75) Inventors: Scott Peters, Rochester, NY (US); Nancy E. Peters, Akron, NY (US); David Lyndaker, Holley, NY (US)

(73) Assignee: DNS Designs, LLC, Pittsford, NY (US)

( * ) Notice: Subject to any disclaimer, the term of this patent is extended or adjusted under 35 U.S.C. 154(b) by 395 days.

(21) Appl. No.: 12/484,296

(22) Filed: Jun. 15, 2009

(65) Prior Publication Data

US 2010/0313387 A1 Dec. 16, 2010

(51) Int. Cl.
*A44B 19/38* (2006.01)

(52) U.S. Cl. ..... 24/388; 24/433

(58) Field of Classification Search ..... 24/388, 24/433–435

See application file for complete search history.

(56) References Cited

U.S. PATENT DOCUMENTS

| | | | | |
|---|---|---|---|---|
| 3,583,041 | A * | 6/1971 | Horwitt | 24/388 |
| 4,232,430 | A | 11/1980 | Friedberg | |
| 5,791,023 | A | 8/1998 | Comerford | |
| 6,026,547 | A | 2/2000 | O'Donnell Kiely | |
| 6,088,888 | A | 7/2000 | Oda | |
| 6,826,810 | B2 | 12/2004 | Ichikawa et al. | |
| 7,036,192 | B2 * | 5/2006 | Yoneoka | 24/443 |

FOREIGN PATENT DOCUMENTS

| | | | |
|---|---|---|---|
| JP | 2005246006 A | * | 9/2005 |
| JP | 2007229411 A | * | 9/2007 |

* cited by examiner

*Primary Examiner* — James Brittain
(74) *Attorney, Agent, or Firm* — Patent Technologies, LLC; Robert D. Gunderman, Jr.

(57) ABSTRACT

A fastening device comprising a pin affixed to a first zipper track, the pin comprising a first magnet and at least a first engaging element; a box affixed to a second zipper track, the box comprising a second magnet and comprising at least a second engaging element complementary to the first engaging element of the pin, wherein the pin and box form a single element through the releasable interaction of the first and second magnets, and the first engaging element of the pin reversibly interacting with the second engaging element of the box; and a first slider body, wherein the first slider body comprises at least one releasing element that reversibly disengages the first engaging element of the pin from the second engaging element of the box. The fastening device can also include a second slider body component comprising a second magnet and defining at least one groove element, wherein the first and second slider body components form a single slider body through the releasable interaction of the first and second magnets, and the ridge element of the first slider body component removably fitting into the groove element of the second slider body component.

19 Claims, 9 Drawing Sheets

ZIPPER

BACKGROUND OF THE INVENTION

1. Field of the Invention

The present invention is related to a zipper-type fastening device, and, more particularly, to an improved pin and box assembly and improved slider body.

2. Description of the Related Art

In the years since their invention, zippers have become ubiquitous. Zippers can be found in all types of clothing such as pants, dresses, and jackets, on carriers such as bags and luggage, and in gear such as sleeping bags and tents. In addition to serving as decoration, zippers can join together two sides of a garment, such as in the operation of a dress, and can serve as means to removably attach two pieces of fabric, such as in the attachment of a removable hood to a jacket.

Fastening devices such as zippers can be separating or non-separating, and can be one-way or two-way devices. In a separating zipper, each of the two zipper tracks, comprising the tape and attached teeth, are connected to different elements that are primarily joined only by the interlocking zipper teeth. In a non-separating zipper, both zipper tracks are connected to a single element such that interlocking and unlocking the zipper teeth creates an opening in that element. A two-way zipper comprises two slider bodies that can work together or separately to interlock and unlock the zipper teeth. A one-way zipper comprises a single slider body as well as a pin and box assembly that aligns the zipper teeth contained on at least one of the zipper tracks.

In their simplest form, one-way separating zippers are composed of relatively few parts, including: an origination assembly with a pin and a retainer body at the lower limit of each row of zipper teeth; two pieces of tape that are attached to fabric on one side and contain zipper teeth on the other; a slider body with a pull-tab; and two top stops at the upper limit of each row of teeth.

To fasten two pieces of fabric together, the operator inserts the pin from the lower limit of one row of teeth into the retainer box at the matching lower limit of the other row of teeth. This aligns the teeth into an operable interlocking format. Once aligned, the operator pulls the latching mechanism, called the slider body, along the teeth track. Wedges inside the slider body force the teeth of each track to interact. If the teeth are aligned, the hook of each tooth settles into the hollow of an opposing tooth. The operator can continue to pull the slider body and interlock the teeth until the slider terminates at the top stops located at the upper limit of each row of teeth.

To unfasten the pieces of fabric, the operator pulls the slider body back along the closed track. The wedges inside the slider body force the interlocking teeth apart and separate the zipper closure.

Despite the ease with which zipper-type closures operate, many individuals encounter difficulty joining together the pin and body. Others may have difficulty grasping the small slider body or pulling it along the zipper's teeth. Examples of individuals who often encounter these difficulties include small children, people wearing gloves for protection, elderly, and people with poor vision, macular degeneration, or cataracts. Additionally, people with disabilities such as arthritis, multiple sclerosis, cerebral palsy, pervasion developmental disorders, Down's syndrome, ataxia, diabetes with neuropathy, stroke (CVA), paraplegics, Lou Gehrig's Disease, Parkinson's, and head injuries can also find the operation of zippers to be difficult.

It is therefore a principal object and advantage of the present invention to provide a device for easier alignment of the pin and box of a zipper.

It is another object and advantage of the present invention to provide a device for easier operation of a zipper slider body.

It is a further object and advantage of the present invention to provide an improved zipper for use by individuals with limited dexterity.

Other objects and advantages of the present invention will in part be obvious and in part be expressed hereinafter.

SUMMARY OF THE INVENTION

In accordance with the foregoing objects and advantages, the present invention provides a fastening device comprising: (1) a pin affixed to a first zipper track, the pin comprising a first magnet and at least a first engaging (or interlocking) element; (2) a box affixed to a second zipper track, the box comprising a second magnet and comprising at least a second engaging (or interlocking) element complementary to the first interlocking element from the pin, wherein the pin and box form a single element through the releasable interaction of the first and second magnets, and the first interlocking element of the pin reversibly interacting with the second interlocking element of the box; and (3) a first slider body, wherein the first slider body comprises at least one releasing element that reversibly disengages the first interlocking element of the pin from the second interlocking element of the box. The engaging/interlocking elements preferably correspond in interlocking fashion, but could engage one another in an otherwise conventional manner that doesn't require actual interlocking relation.

The invention further provides a fastening device comprising: (1) a pin affixed to a first zipper track, the pin comprising a first magnet and at least a first interlocking element; (2) a box affixed to a second zipper track, the box comprising a second magnet and comprising at least a second interlocking element complementary to the first interlocking element from the pin, wherein the pin and box form a single element through the releasable interaction of the first and second magnets, and the first interlocking element of the pin reversibly interacting with the second interlocking element of the box; (3) a first slider body, wherein the first slider body comprises at least one releasing element that reversibly disengages the first interlocking element of the pin from the second interlocking element of the box, and further comprising a third magnet as well as defining at least one ridge element; and (4) a second slider body component comprising a fourth magnet and defining at least one groove element, wherein the first and second slider body components form a single slider body through the releasable interaction of the first and second magnets, and the ridge element of the first slider body component removably fitting into the groove element of the second slider body component.

The invention also provides a fastening device comprising: (1) a slider body slidably connected to a first zipper track; (2) a first locking body affixed to said first zipper track, the locking body comprising a first housing element that contains a first magnet, and further comprising a first vertical element that reversibly interacts with the slider body; and (3) a second locking body affixed to a second zipper track, the second locking body comprising a second housing element that contains a second magnet, and further comprising a second vertical element, wherein the first and second locking bodies reversibly form a single element through the releasable interaction of the first and second magnets.

BRIEF DESCRIPTION OF THE DRAWINGS

The present invention will be more fully understood and appreciated by reading the following Detailed Description in conjunction with the accompanying drawings, in which.

DETAILED DESCRIPTION OF THE INVENTION

Figure 1:
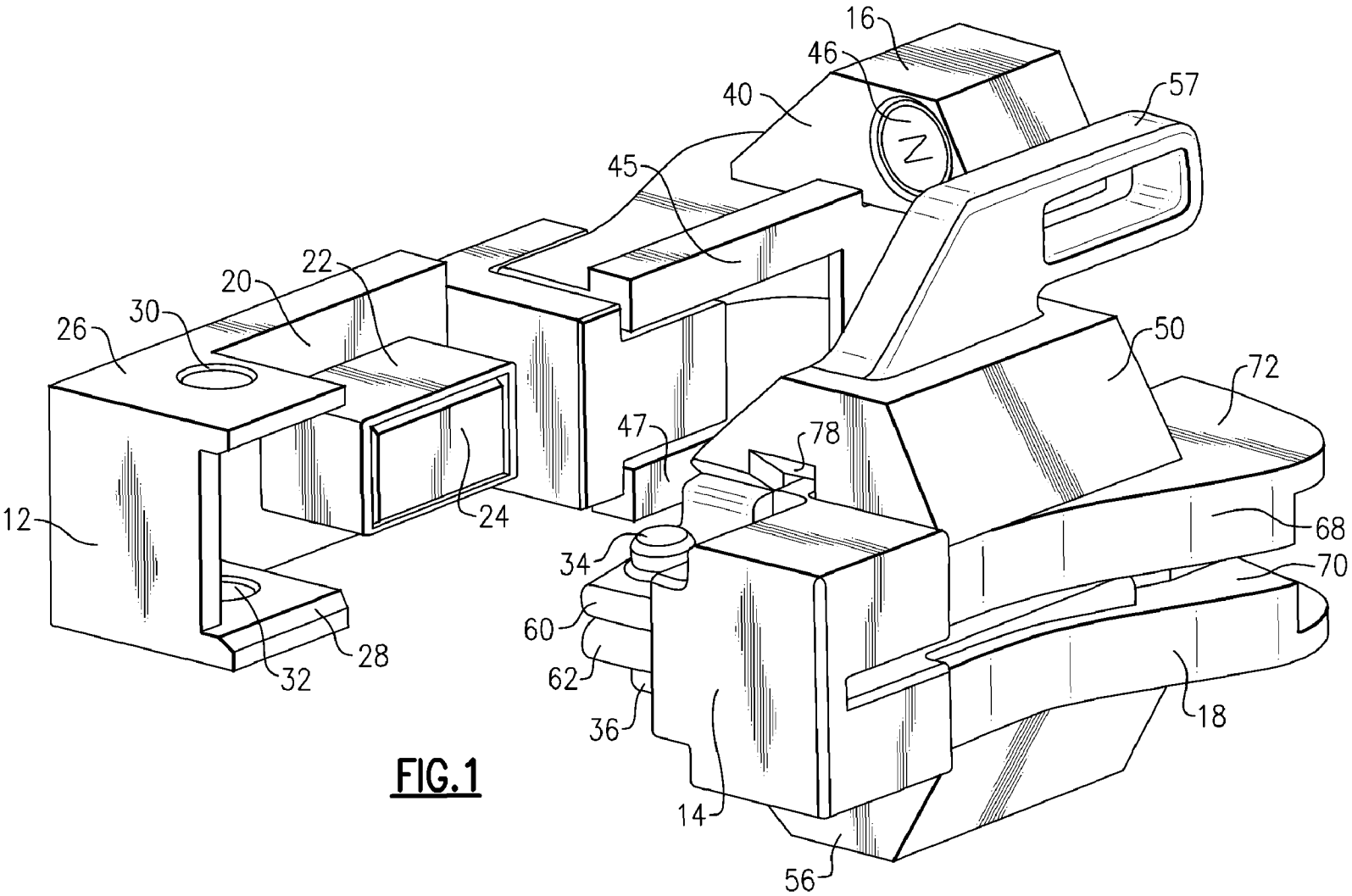
FIG. 1 is a side elevation view of a one-way separating zipper assembly according to the present invention with the right and left sections of the assembly in the unassembled configuration and showing the interior of the box section.
Figure 2:
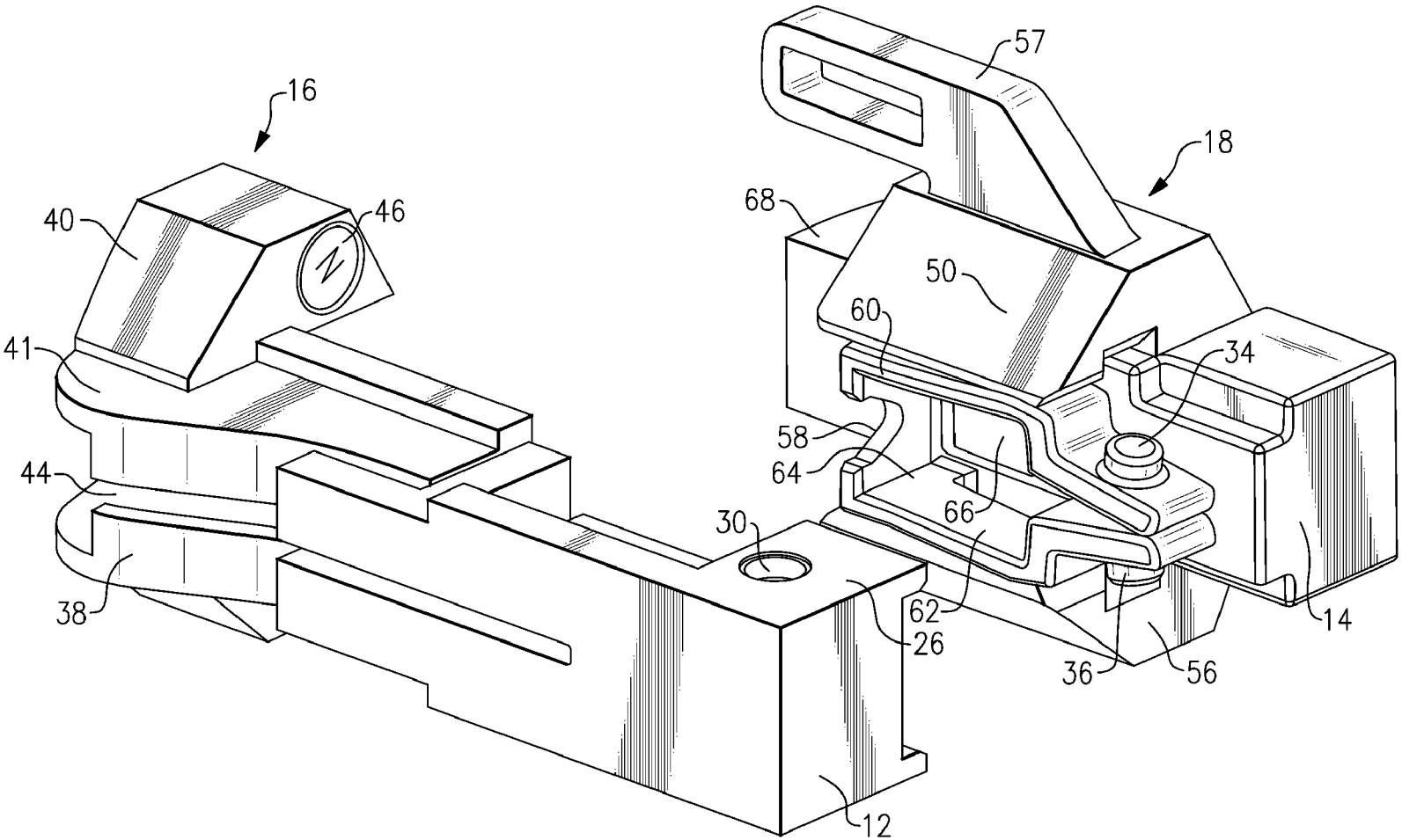
FIG. 2 is a side elevation view of a one-way separating zipper assembly according to the present invention with the right and left sections of the assembly in the unassembled configuration and showing the interior of the pin section.
Figure 3:
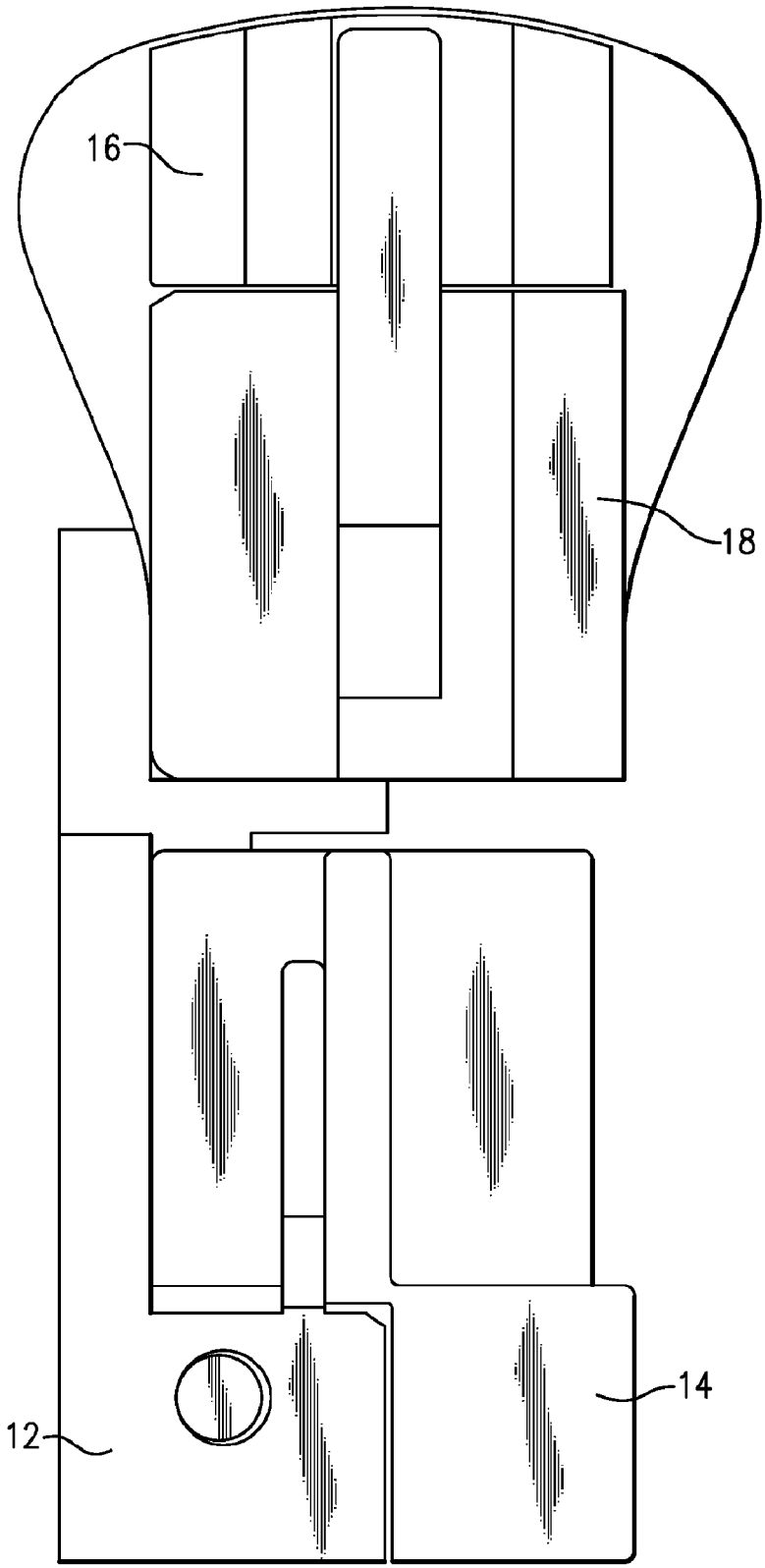
FIG. 3 is a front view of the present invention with the right and left sections of the zipper assembly in the unassembled configuration.

Referring now to the drawings wherein like reference numerals designate identical or corresponding parts throughout the several views, there is shown in FIG. 1-3 elevation views of the unassembled fastening device. The fastening device comprises four separably interlocking components: a box 12, a pin 14, a first slider body component 16 which is one half of the slider body, and a second slider body component 18 which is the other half of the slider body.

Box 12 is permanently attached to the lower limit of a first zipper track. Defined in box 12 is a cavity 20 for the removable attachment of pin 14 upon assembly. Inside cavity 20 is an extended sleeve 22 surrounding a magnet 24 to facilitate assembly of the box and pin as well as to assist in the alignment of the zipper tracks (not shown). Defined in the upper lip 26 and lower lip 28 of the box are holes 30 and 32, respectively, which accept pegs 34 and 36 of pin 14 upon assembly.

First slider body component 16 is removably attached to box 12 and is permanently mounted on the first zipper track, although it is free to move along the entire length of the track. Slider body component 16 is comprised of three permanently connected sections; a main body section 38, an upper arm 40, and a lower arm 42. The main body of the first slider body component defines a cavity 44 along the entire length of the slider body through which the first zipper track travels when the slider body is assembled and actively interlocking or unlocking the zipper teeth. Upper arm 40 and lower arm 42 extend laterally from the upper surface 41 and lower surface 43 of main body section 38 opposite the first zipper track. Protruding from upper surface 41 is a ridge 45 that terminates at upper arm 40, and protruding from lower surface 43 is a ridge 47 that terminates at lower arm 42. To facilitate assembly with second slider body component 18, upper arm 40 contains an embedded and partially exposed magnet 46 that attracts a magnet 48 similarly embedded and partially exposed in the upper arm 50 of the second slider body. Lower arm 42 of the first slider body contains a similar magnet 52 that attracts a magnet 54 in the lower arm 56 of the second slider body which holds the slider body together while it is being slid to an unzipped state.

Pin 14 is permanently attached to the lower limit of a second zipper track and is removably attached to second slider body component 18. An inflexible wall 58 extends laterally from the main body 58 of the pin. Flexibly attached to the top and bottom of wall 58 is upper arm 60 and lower arm 62, respectively. Arms 60 and 62 are biased away from each other. Affixed to the outer surface of upper arm 60 is a peg 34 that fits into hole 30 formed in upper lip 26 of the box when the zipper components are assembled. Similarly, the outer surface of lower arm 62 contains a peg 36 that fits into hole 32 formed in lower lip 28 of the box. Arms 60 and 62 define a cavity 64 which contains a partially exposed magnet 66 embedded in the main body of the pin.

Second slider body component 18 is removably attached to pin 14 and is permanently mounted on the second zipper track, although it is free to move along the entire length of the track. Slider body component 18 is comprised of four permanently affixed sections; a main body section 68, an upper arm 50, a lower arm 56, and a pull tab 57. The main body of the second slider body component defines a cavity 70 along the entire length of the slider body through which the first zipper track travels when the slider body is assembled and actively interlocking or unlocking the zipper teeth. Upper arm 50 and lower arm 56 protrude laterally from the upper surface 72 and lower surface 74 of main body section 68 opposite the second zipper track. Lower surface 76 of upper arm 50 defines a groove 78 that runs the length of surface 76. Similarly, upper surface 80 of lower arm 56 defines a groove 82 that runs the length of surface 80, such that groove 78 and groove 82 are facing one another when the zipper is unassembled. To facilitate assembly with the first slider body component 16, upper arm 50 contains an embedded but partially exposed magnet 48 that attracts magnet 46 in upper arm 40 of the first slider body. Lower arm 56 of the second slider body contains a similar magnet 54 that attracts a magnet in the lower arm 42 of the first slider body.

When pin 14 and second slider body component 18 are assembled, upper arm 50 and lower arm 56 of the slider body component push arms 60 and 62 of the pin against their bias and towards each other. This allows the pin arms 60 and 62 to easily fit into cavity 20 and prevents the pin and box from prematurely locking together.

Figure 4:
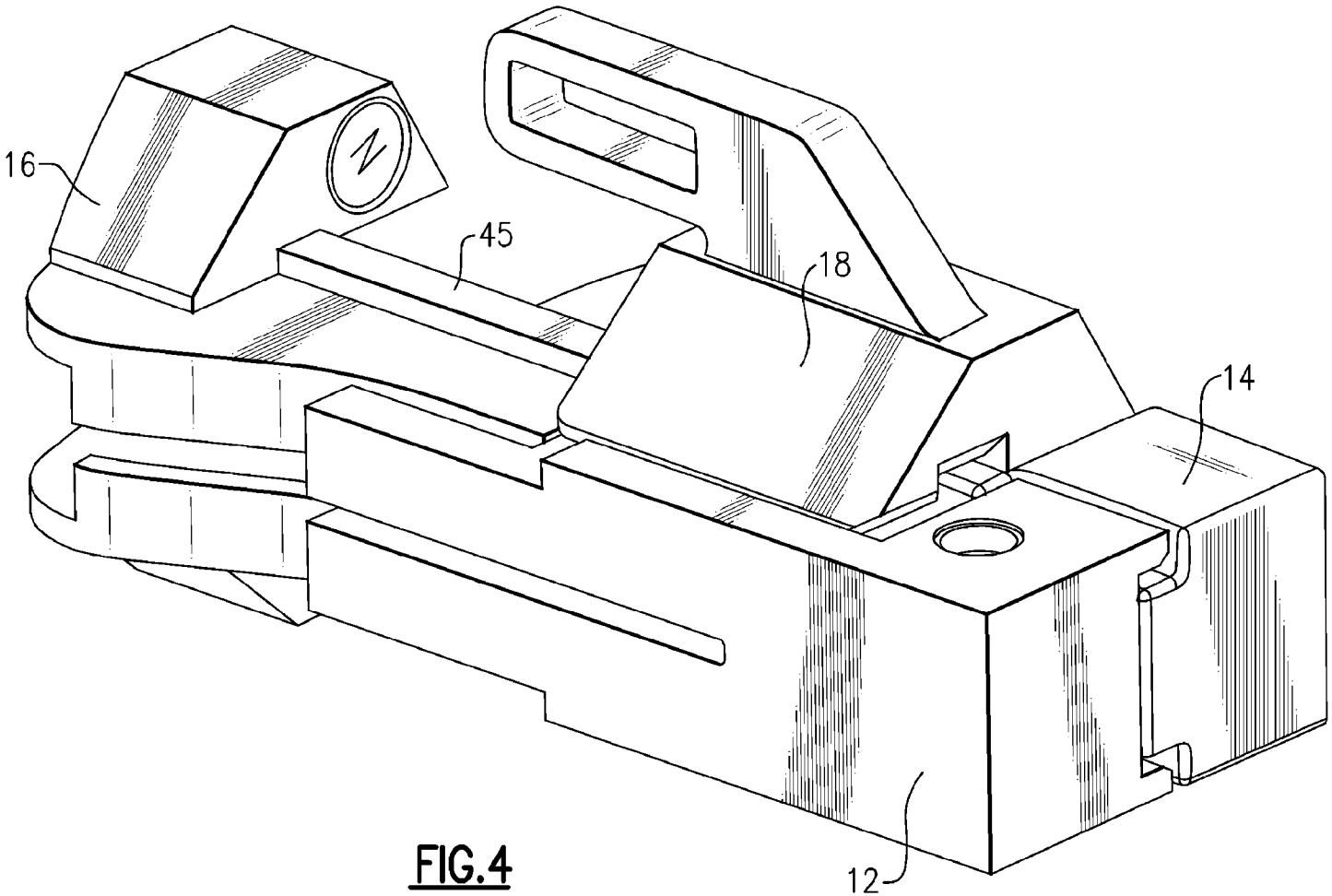
FIG. 4 is a side elevation view of the present invention with assembled pin and box and unassembled slider body.

FIG. 4 is a side elevation view of the present invention with the pin and box of the assembled and the slider body unassembled. Upon assembly of the pin and box, sleeve 22 of box 12 fits snugly into cavity 64 of pin 14. Attraction forces between magnet 24 in the box and magnet 66 in the pin assist in aligning and pulling the two components tightly together. Optionally, one of either magnet 24 or magnet 66 can be replaced with a ferromagnetic material such that the two components will still form an attractive force. The ferromagnetic material is any material or component that exhibits a strong interaction with a magnetic force. For example, this material can include natural elements or minerals, rare earth metals, or alloys.

Once box 12 and pin 14 are removably attached, groove 78 formed in upper arm 50 of the second body component is able to freely slide along ridge 45 of the first body component. Similarly, groove 82 formed in lower arm 56 of the second body component is able to freely slide along ridge 47. As second slider body component 18 slides along the ridges towards upper arm 40 and lower arm 42 of the first slider body component, magnets 48 and 54 in slider body component 18 attract magnets 46 and 52 in slider body component 16.

Figure 5:
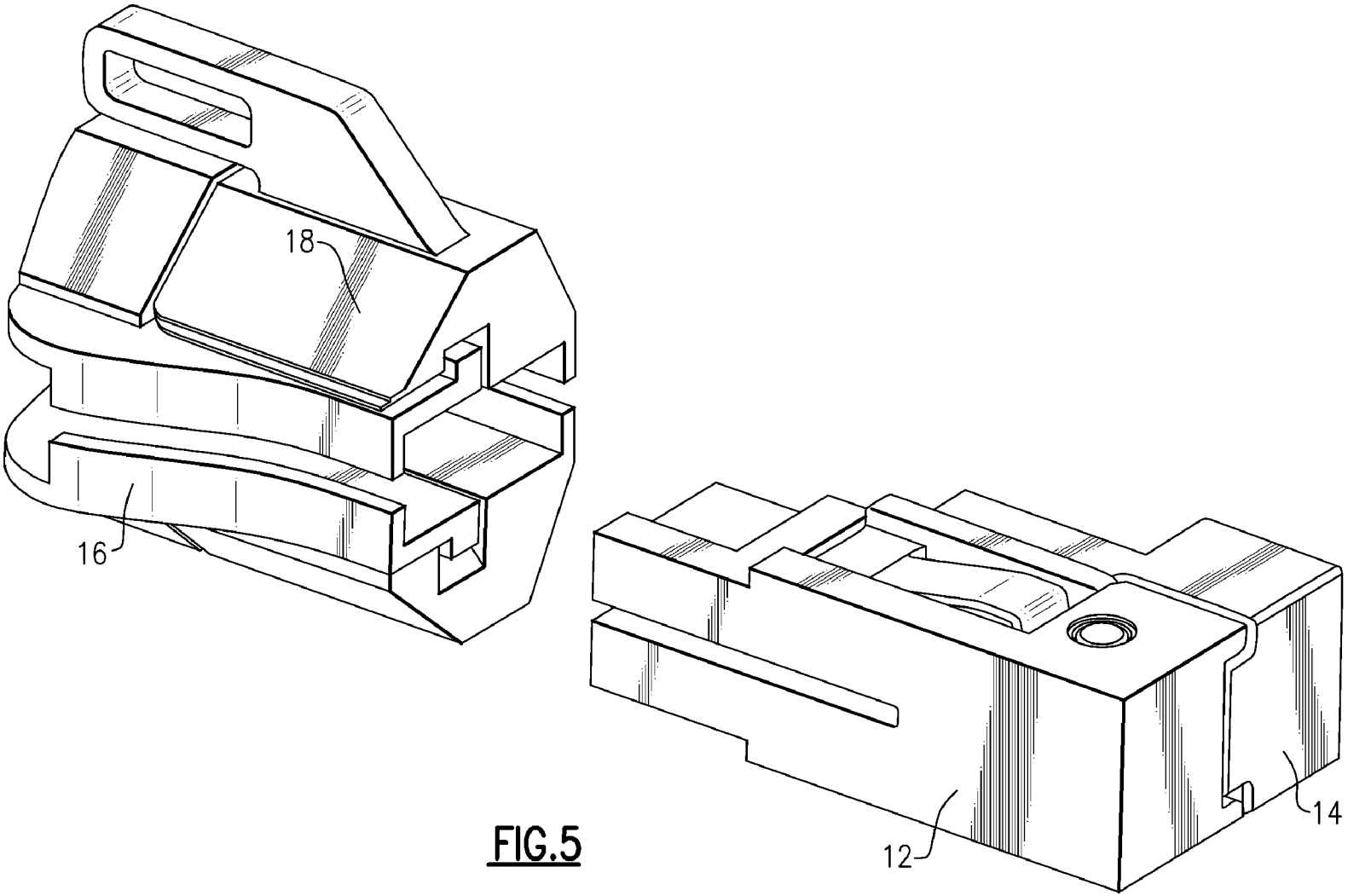
FIG. 5 is a side elevation view of the present invention with the assembled slider body pulling away from the assembled pin and box.

Additionally, as the second slider body component slides over the first slider body component and away from pin 14, flexible arms 60 and 62 of the pin, which are now located inside cavity 20 of box 12, are allowed to return to their bias. Holes 30 and 32 of the box accept pegs 34 and 36 on the arms of the pin, removably interlocking pin 14 and box 12, as shown in FIG. 5. When the slider assembly returns to the box and pin assembly, arms 60 and 62 are again forced against their bias. When that happens, the pegs are forced out of the holes and the arms are free to slide out of cavity 20.

In addition to the resilient interlocking element described above, pin 14 and box 12 can be designed to possess any mechanism that allows the pin and box to reversibly interact. For example, the reversible interaction can be achieved by just using magnet 24 in the box and magnet 66 in the pin without any additional locking element.

Attraction forces between magnet 24 in the box and magnet 66 in the pin assist in aligning and pulling the two components tightly together.

When the slider body is fully assembled, the arms of the first slider body component are flush with the arms of the second slider body component, as shown in FIG. 5. The assembled slider body is free to travel the length of the zipper track. As the first and second unlocked zipper tracks travel through the slider body, they are forced to interact and exit the slider body as a single interlocked element.

To unlock the zipper teeth, the assembled slider body is pulled back along the track and the interlocked zipper teeth re-enter the slider body. Wedges inside the slider body force the interlocking teeth apart and separate the tracks from each other.

Figure 6:
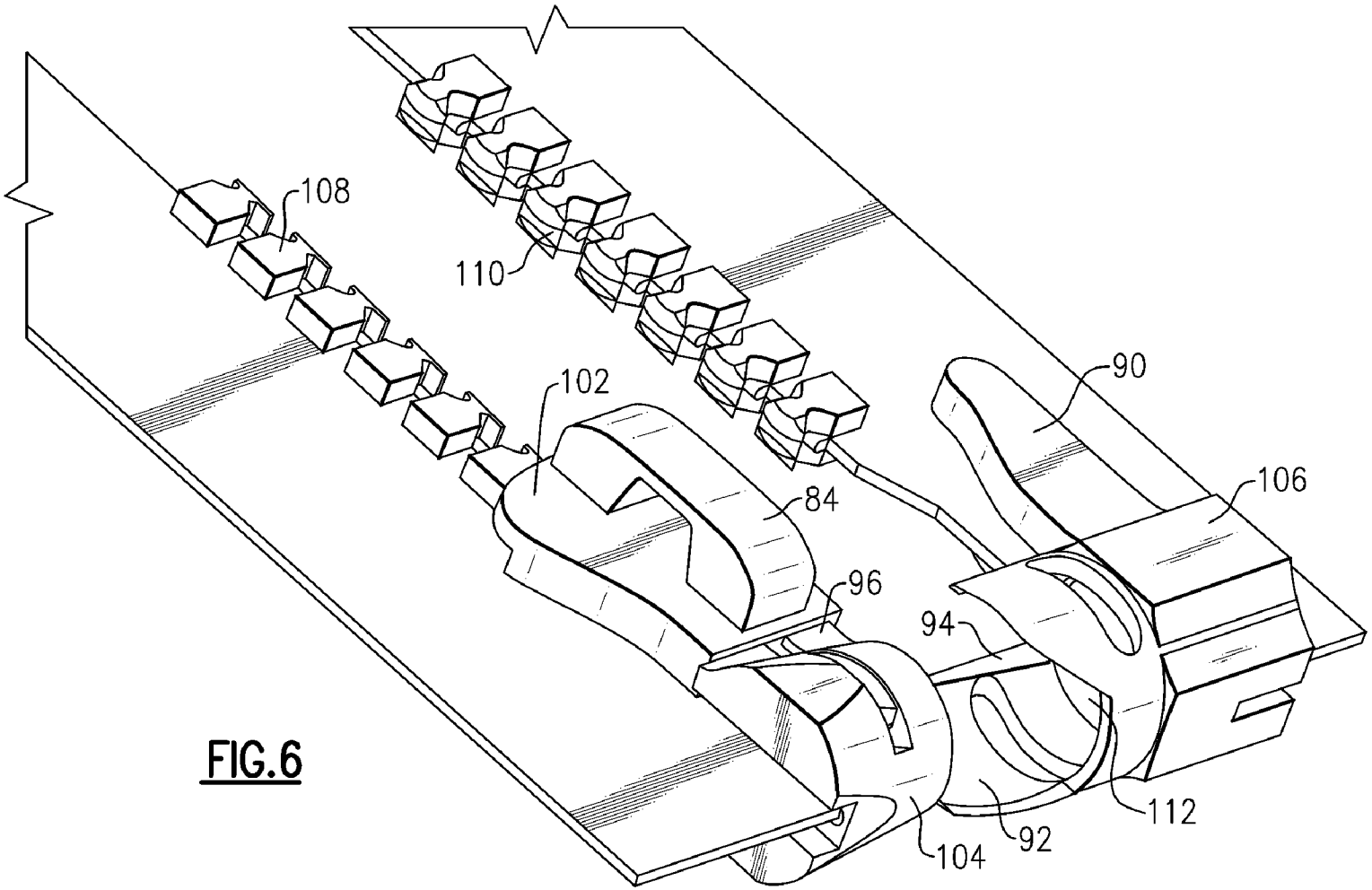
FIG. 6 is a front view of a second embodiment of the present invention with the right and left sections of the assembly in the unassembled configuration.

FIG. 6 is a front view of a second embodiment of the present invention. The fastening device comprises three separably interlocking components: a slider body 102, a first lower body 104 and a second lower body 106. In this embodiment, lower bodies 104 and 106 replace the traditional pin and box assembly. First lower body 104 is permanently attached to the lower limit of a first zipper track 108. In a preferred embodiment, first lower body 104 is rounded and contains an embedded but partially exposed magnet 83 (shown in FIG. 7) to attract a similarly embedded but partially exposed magnet 112 in second lower body 106.

Slider body 102 is removably attached to first lower body 104 and is permanently mounted on first zipper track 108, although it is free to move along the entire length of the track. Slider body 102 optionally comprises a structure 84 for fastening or connecting a loop or similar component used to pull the slider body up and down the zipper track. The main body of slider body 102 defines a cavity 86 (shown in FIG. 7) along both sides of the length of the slider body through which first zipper track 108 and second zipper track 110 travel when the slider body is actively interlocking or unlocking the zipper teeth.

Second lower body 106 is permanently mounted to the lower limit of second zipper track 110. In a preferred embodiment, second lower body 106 contains magnet 112 that attracts magnet 83 in lower body 104. Optionally, one of either magnet 112 or the magnet in lower body 106 can be replaced with a ferromagnetic material such that the two components will still form an attractive force. Lower body 106 also has an extension 90 on both sides of zipper track 110. During assembly, extension 90 guides slider body 102 into the proper alignment on zipper track 110 such that the zipper track enters cavity 86 in the slider body.

Figure 8:
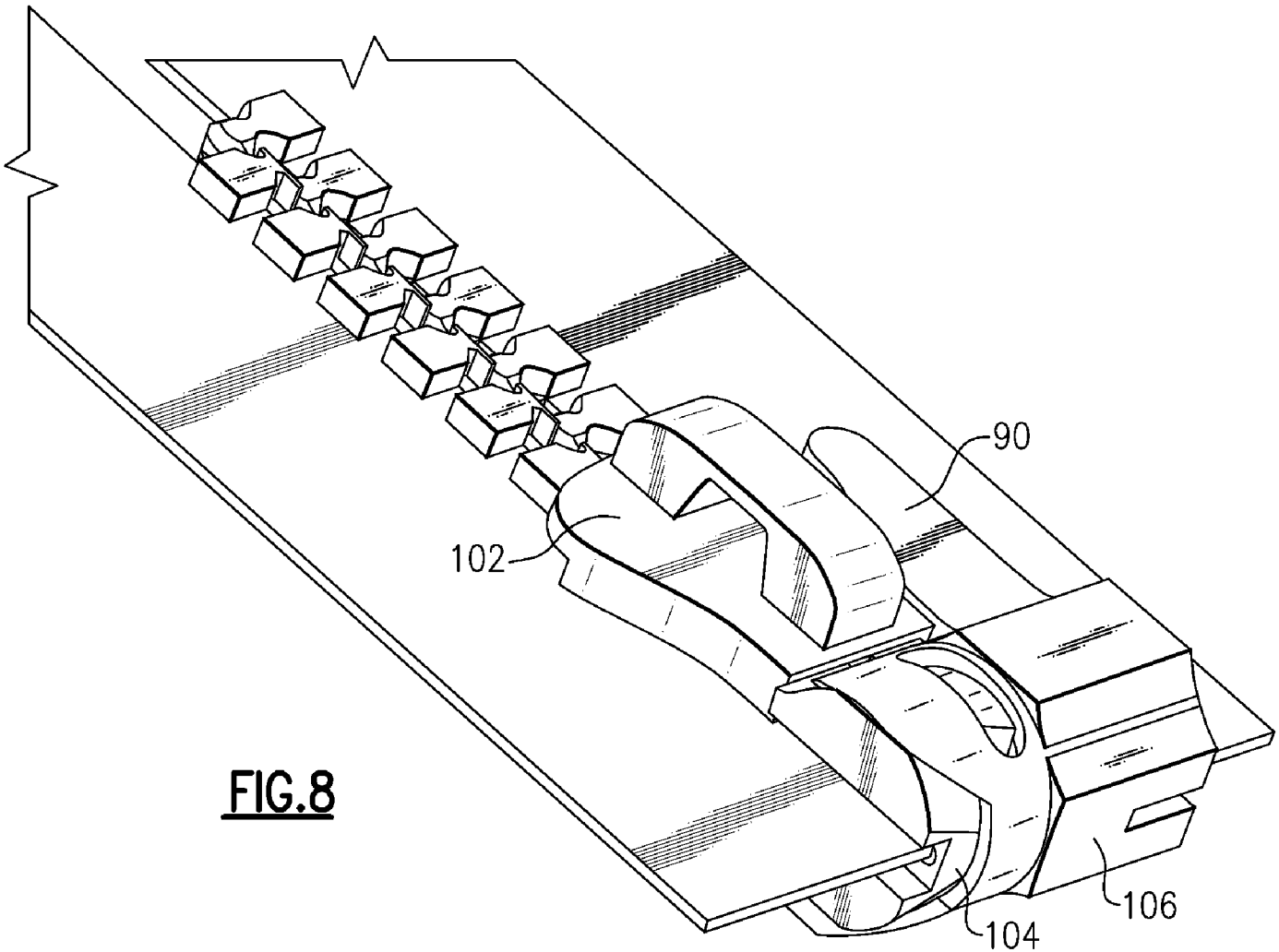
FIG. 8 is a front view of the second embodiment with the right and left sections of the assembly in the assembled configuration.

In one embodiment, lower body 106 possesses an extending guidance element 92. The guidance element facilitates and guides lower body 104 into alignment with lower body 106, thereby bringing slider body 102 into proper orientation. The guidance element can be designed to fit over lower body 104, as shown in FIG. 8, with an opening that receives the upper portion of lower body 104. This opening has a flat surface edge on both sides which fit snugly along a complementary flat receiving surface on lower body 104. FIG. 6 shows one flat edge 94 of the opening in guidance element 92 which slides over a complementary flat receiving surface (not shown) on the reverse side of lower body 104. Also shown in FIG. 6 is the complementary flat surface 96 which receives the opposite flat edge (not shown) of the opening in guidance element 92. The pairing of these surfaces will rotate the two lower bodies of the mechanism such that they are properly aligned as they come together, thereby facilitating proper alignment of slider body 102 with the zipper tracks.

Guidance element 92 can be conical in shape to further facilitate alignment of the two lower bodies and thus the slider body. For example, the walls of the guidance element can be thicker at the base and thinner at the top; as the opposite lower body is brought into the guidance element, the narrowing walls guide the lower body into the proper alignment.

The guidance element can also define an opening in the area of the element opposite the zipper tracks, as shown in FIG. 6. This allows a user to pull lower body 104 into guidance element 92 from below as with traditional pin and box zipper assemblies.

In a preferred embodiment, magnet 83 in lower body 104 and magnet 112 in lower body 106 are brought into proximity such that they form a strong magnetic interaction but do not physically touch one another. This maximizes magnetic interaction while allowing the user to easily pull apart the lower bodies.

Figure 7:
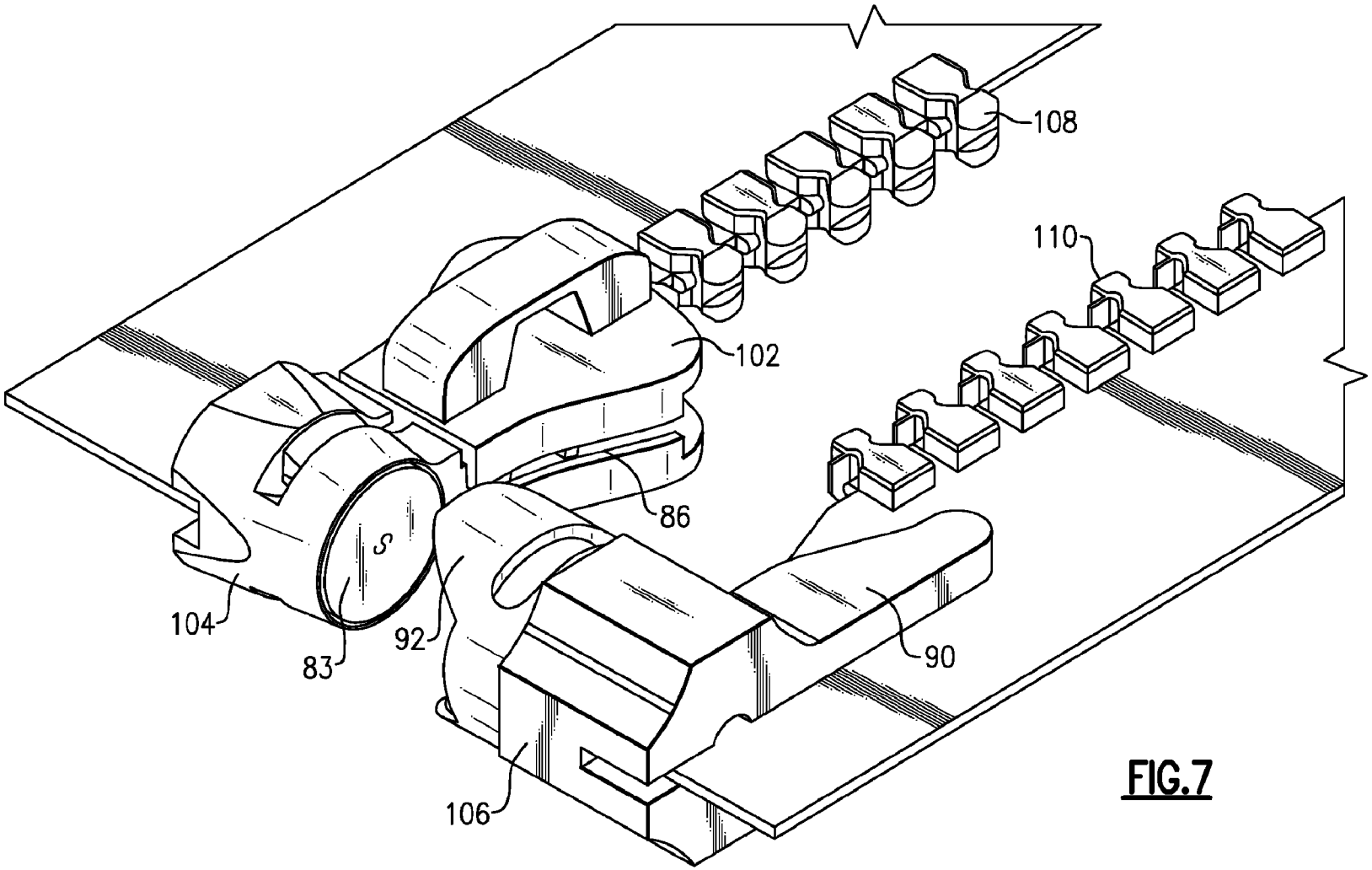
FIG. 7 is a front view of a second embodiment of the present invention with the right and left sections of the assembly in the unassembled configuration.

FIG. 7 is a front view of a second embodiment of the present invention with the right and left sections of the assembly in the unassembled configuration. In this view, magnet 83 in lower body 104 is visible, as is cavity 86 in slider body 102.

FIG. 8 is a front view of the second embodiment of the present invention in the assembled configuration. When first lower body 104 and second lower body 106 are brought into close proximity, the magnets contained with the bodies attract one another and pull them into the assembled configuration. In the assembled configuration, extension 90 of second lower body 106 guides slider body 102 into the proper orientation on zipper track 110. As a result, the zipper teeth of tracks 108 and 110 are brought into close proximity and slider body 102 is free to travel the length of the zipper tracks. As the first and second unlocked zipper tracks travel through the slider body, they are forced to interact and exit the slider body as a single interlocked element. To unlock the zipper teeth, slider body 102 is pulled back along the track and the interlocked zipper teeth re-enter the slider body. Wedges inside the slider body force the interlocking teeth apart and separate the tracks from each other.

Figure 9:
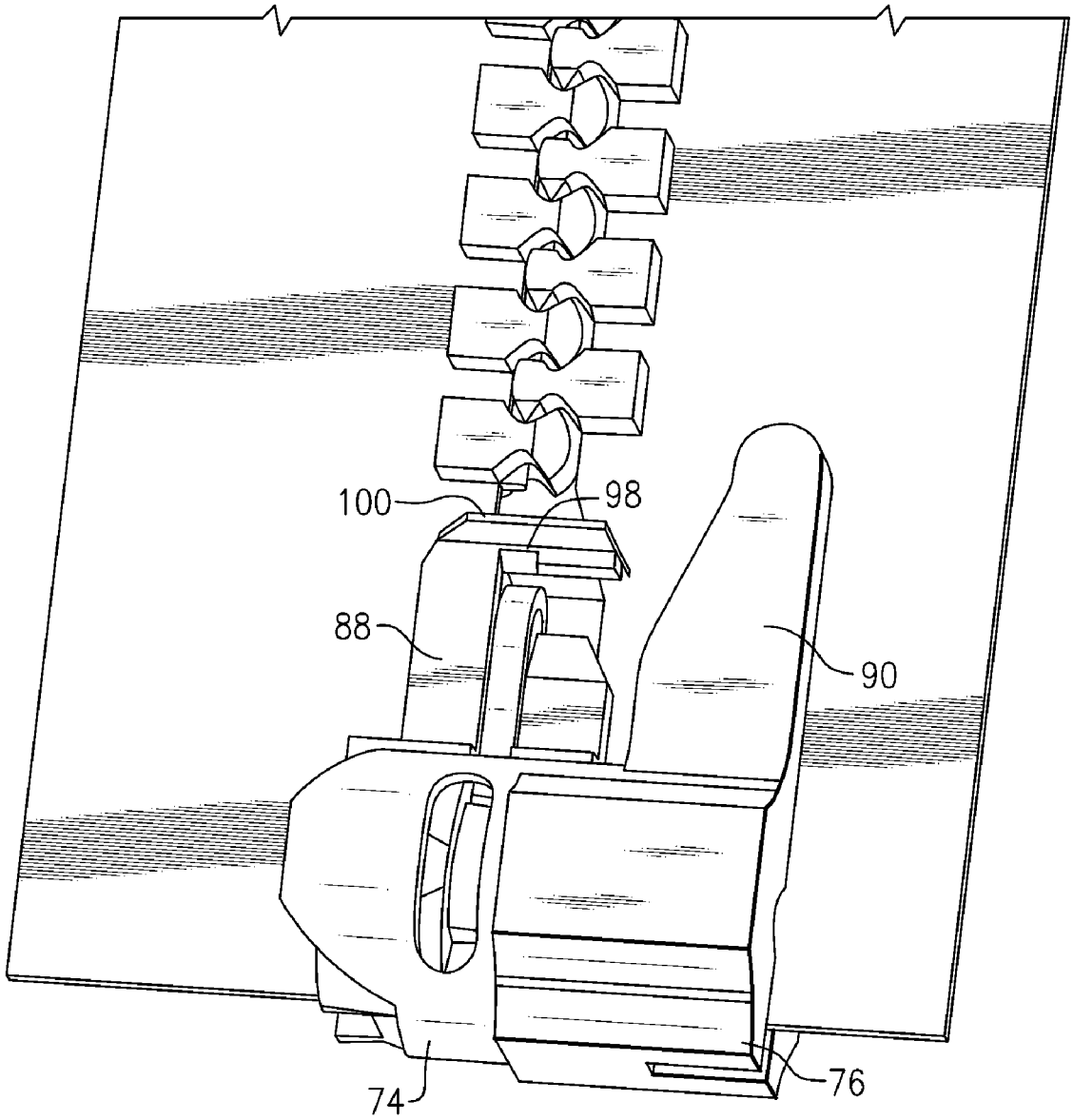
FIG. 9 is a front view of the second embodiment with the right and left sections of the pin and box assembly in the assembled configuration where the slider body has pulled away from the pin and box assembly.

FIG. 9 is a front view of the second embodiment with the right and left sections of the pin and box assembly in the assembled configuration where slider body 102 has pulled away from the pin and box assembly. Lower body 104 can optionally possess an extension 88 which extends from the lower body along zipper track 108. The extension can be designed to fit inside slider body 102. Extension 88 can also be designed to maintain stiffness and/or alignment between lower body 104 and the first tooth of zipper track 108. This stiffness or alignment will assist in proper functioning of the slider body. Extension 88 can possess an element 98 that reversibly engages with en element (not shown) of slider body 102 to hold the slider body in place until the slider is pulled. To allow slider body 102 to easily engage the base structure formed by the joining of lower bodies 104 and 106, extension 88 can be designed to possess a lead-in element 100. Lead-in element 100 extends horizontally from extension 88 and can reversibly interact with the opposite side of the zipper mechanism. In a preferred embodiment, the upper edge of lead-in element 100 is tapered to guide slider body 102 onto the base structure.

Another mechanism to assist in proper functioning of slider body 102 is to use a tapered or narrowed first tooth on zipper track 108. The taper would allow the slider to more easily engage the tooth. Additionally, slider body 102 could be modified to possess a lead-in element (not shown) that facilitates engagement of the first zipper tooth with the slider, or could be modified to have a wider opening on the upper edge that interacts with the opposite zipper track.

In yet another embodiment of the present invention the two lower bodies fit together with one on top of the other to bring the zipper tracks in alignment, rather than side-by-side. In this configuration, the topmost lower body would contain a magnet or other element positioned to interact with a magnet or complementary element in the lowermost lower body. Once the lower bodies are properly aligned, the slider body is also in the proper alignment and can be used to interlock the zipper tracks.

Although the present invention has been described in connection with a preferred embodiment, it should be understood that modifications, alterations, and additions can be made to the invention without departing from the scope of the invention as defined by the claims.

What is claimed is:

1. A fastening device, the fastening device comprising:

a pin affixed to a first zipper track, the pin comprising a first magnet and at least a first engaging element;

a box affixed to a second zipper track, the box comprising a second magnet and comprising at least a second engaging element complementary to the first engaging element, wherein the pin and box form a single element through the releasable interaction of the first and second magnets, and the first engaging element of the pin reversibly interacting with the second engaging element of the box; and a first slider body, wherein the first slider body comprises at least one releasing element that reversibly disengages the first engaging element from the second engaging element.

2. The fastening device of claim 1, wherein the first engaging element is a resilient member and the second engaging element reversibly receives the resilient member.

3. The fastening device of claim 1, wherein said first or second magnet comprises at least partly of a ferromagnetic material.

4. The fastening device of claim 1, wherein said first slider body further comprises a third magnet and defines at least one ridge element, and further comprising:

a second slider body component comprising a fourth magnet and defining at least one groove element, wherein the first and second slider body components form a single slider body through the releasable interaction of the first and second magnets, and the ridge element of the first slider body component removably fitting into the groove element of the second slider body component.

5. The fastening device of claim 4, wherein said first, second, third, or fourth magnet comprises at least partly of a ferromagnetic material.

6. The fastening device of claim 1, wherein said first and second engaging elements are adapted to interlock with one another.

7. A fastening device, the device comprising:

a slider body slidably connected to a first zipper track;

a plurality of teeth beginning with a first tooth connected to the first zipper track;

a first locking body affixed to said first zipper track, the locking body comprising a first housing element that contains a first magnet, and further comprises a first vertical element that reversibly interacts with the slider body; and a second locking body affixed to a second zipper track;

a plurality of teeth beginning with a first tooth connected to the second zipper track;

the second locking body comprising a second housing element that contains a second magnet, and further comprises a second vertical element, wherein the first and second locking bodies reversibly form a single element through the releasable interaction of the first and second magnets.

8. The fastening device of claim 7, wherein said first or second magnet is a ferromagnetic material.

9. The fastening device of claim 7, wherein the first or second locking body further comprises a protruding guidance element.

10. The fastening device of claim 9, wherein the protruding guidance element comprises a cavity to reversibly receive at least a portion of the first or second locking body.

11. The fastening device of claim 10, wherein said cavity is at least partly defined by a wall that progressively narrows from the base to the distal end.

12. The fastening device of claim 10, wherein said cavity is at least partly defined by a wall, the wall further comprising an opening such that the wall does not completely encompass the cavity.

13. The fastening device of claim 12, wherein said opening further comprises a flat surface on each side of the opening which reversibly slide onto complementary flat surfaces on the first or second locking body.

14. The fastening device of claim 7, wherein said first or second housing element prevents physical contact between the first and second magnet but allows magnetic interaction between said first and second magnet.

15. The fastening device of claim 7, wherein the first tooth of the first zipper track is modified to facilitate interaction between the slider body and said first tooth.

16. The fastening device of claim 7, wherein the first vertical element comprises a locking mechanism that reversibly interacts with the slider body.

17. The fastening device of claim 7, wherein said first vertical element comprises a protruding horizontal element that extends toward said second zipper track.

18. The fastening device of claim 17, wherein the upper edge of said protruding horizontal element is tapered.

19. The fastening device of claim 7, wherein the slider body is modified to facilitate engagement of a first tooth of said first zipper track with said slider body.

* * * * *